US009795812B2

(12) United States Patent
Charlton

(10) Patent No.: US 9,795,812 B2
(45) Date of Patent: Oct. 24, 2017

(54) FIRE RETARDANT DELIVERY METHOD AND APPARATUS

(75) Inventor: Eric F. Charlton, Grapevine, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 710 days.

(21) Appl. No.: 13/214,532

(22) Filed: Aug. 22, 2011

(65) Prior Publication Data

US 2013/0048317 A1 Feb. 28, 2013

(51) Int. Cl.

| | |
|---|---|
| ***A62C 35/02*** | (2006.01) |
| ***A62C 3/02*** | (2006.01) |
| ***F42B 12/50*** | (2006.01) |
| *A62C 35/08* | (2006.01) |
| *F42B 12/46* | (2006.01) |

(52) U.S. Cl.

CPC ..... *A62C 3/025* (2013.01); *F42B 12/50* (2013.01); *A62C 35/08* (2013.01); *F42B 12/46* (2013.01)

(58) Field of Classification Search

CPC ..... A62C 3/025; A62C 35/08; F42B 12/50

USPC ..... 169/30, 46, 53, 56, 60, 61, 71, 75; 102/369, 370, 393

See application file for complete search history.

(56) References Cited

U.S. PATENT DOCUMENTS

| | | | | |
|---|---|---|---|---|
| 3,712,219 | A * | 1/1973 | Blair et al. | 102/369 |
| 4,455,943 | A * | 6/1984 | Pinson | 102/489 |
| 4,638,736 | A * | 1/1987 | Farmer | 102/393 |
| 5,052,271 | A * | 10/1991 | West | 89/1.55 |
| 6,672,220 | B2 * | 1/2004 | Brooks et al. | 102/489 |
| 6,675,789 | B2 * | 1/2004 | Pearce et al. | 124/56 |
| 6,722,283 | B1 * | 4/2004 | Dindl et al. | 102/489 |
| 6,779,463 | B2 * | 8/2004 | Mutascio et al. | 102/502 |
| 7,543,533 | B2 * | 6/2009 | Montefusco | 102/370 |
| 7,836,965 | B2 * | 11/2010 | Korenkov et al. | 169/28 |
| 7,975,774 | B2 * | 7/2011 | Akcasu | 169/46 |
| 8,165,731 | B2 * | 4/2012 | Akcasu | 701/3 |
| 8,695,847 | B2 * | 4/2014 | Sjobeck et al. | 221/153 |
| 2002/0121382 | A1 * | 9/2002 | Fima et al. | 169/53 |
| 2002/0157558 | A1 * | 10/2002 | Woodall et al. | 102/369 |
| 2005/0139363 | A1 * | 6/2005 | Thomas | 169/30 |
| 2006/0005974 | A1 * | 1/2006 | Setzer | 169/33 |
| 2006/0166171 | A1 * | 7/2006 | Preston et al. | 434/16 |
| 2007/0007021 | A1 * | 1/2007 | Regan | 169/84 |
| 2008/0271900 | A1 | 11/2008 | Korenkov et al. | |

FOREIGN PATENT DOCUMENTS

| | | |
|---|---|---|
| WO | 2009004105 | 1/2009 |

* cited by examiner

*Primary Examiner* — Alexander Valvis

(74) *Attorney, Agent, or Firm* — Reising Ethington P.C.

(57) ABSTRACT

A method and apparatus for delivering fire retardant to a ground fire from an aircraft. The apparatus includes a dispenser casing that dispenses fire retardant after the casing has been released from an aircraft. The apparatus includes a dispenser fuse that actuates the dispenser casing to dispense the fire retardant in response to one or more predetermined conditions.

12 Claims, 5 Drawing Sheets

FIRE RETARDANT DELIVERY METHOD AND APPARATUS

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

This invention relates generally to the use of aircraft to deliver fire retardant to ground fires.

DESCRIPTION OF THE RELATED ART INCLUDING INFORMATION DISCLOSED UNDER 37 CFR 1.97 And 1.98

Known fire retardant delivery systems include bomb casings configured to carry fire retardant rather than explosives, and adapted to be releasably engaged by weapon suspension and release systems of military aircraft configured to carry and deliver MK80 series general purpose bombs. Such systems include fuse systems that interface with a delivering aircraft in the same way as would a fuse system of a MK80 series general purpose bomb. At least one such system is known to include an air bag carried in a bomb casing and configured to push fire retardant from the casing in response to triggering by a fuse system.

At least one such system is known to include a guidance system configured to guide a retardant-filled casing from release to a desired position for retardant to be dispensed on a ground fire target. Such guidance systems have been known to be configured to receive positioning data from GPS satellites.

A cluster bomb unit (CBU) will typically comprise a submunitions dispenser that includes a dispenser casing having suspension hardware adapted to be releasably engaged by weapon suspension and release systems of military aircraft. A plurality of submunitions or bomblets is releasably carried by the dispenser casing. A dispenser fuse system opens the dispenser casing and releases the bomblets at a predetermined time, pressure altitude, or radar-measured altitude above ground level following release of the CBU from an aircraft. The dispenser fuse system mechanically interconnects with a delivering aircraft via fuse arming wire in such a way as to be activated in response to release from the aircraft. Each CBU bomblet includes a bomblet fuse system that detonates the bomblet at a predetermined time or altitude following release of the bomblet from the dispenser, upon ground impact, at a predetermined time following ground impact, or, following ground impact, at a predetermined proximity to an approaching vehicle or person.

Submunitions dispensers, in what's known as the Tactical Munitions Dispenser (TMD) family, e.g., the SUU-64/B (used by CBU-89/B), SUU-65/B (used by CBU-87/B) and SUU-66/B (used by CBU-97/B), may be equipped with a wind-corrected munitions dispenser (WCMD) guidance tail kit. Each such tail kit includes an inertial guidance system coupled to servos that drive flip-out control fins to steer the bomb to predetermined coordinates. The inertial guidance system is coupleable to a GPS of a delivering aircraft to update the WCMD's inertial guidance system immediately before the WCMD is released. After release, the WCMD inertial guidance system corrects for launch errors and winds aloft, and computes an optimum flight path and submunition release point.

BRIEF SUMMARY OF THE DISCLOSURE

A fire retardant delivery apparatus is provided for delivering fire retardant to a ground fire from an aircraft. The apparatus includes a dispenser casing configured to carry and dispense fire retardant and to be releasably carried by a delivering aircraft. The apparatus also includes a dispenser fuse carried by the dispenser casing that is configured to actuate the dispenser casing to dispense the fire retardant in response to one or more predetermined conditions.

The fire retardant delivery apparatus may include a plurality of dispenser modules that are releasably carried by the dispenser casing. The dispenser fuse may be configured to release the dispenser modules from the dispenser casing, and each dispenser module may be configured to release retardant from its module casing following release from the dispenser casing. This allows fire retardant to be released from multiple dispersible sources dispensed from a single casing that may be carried and delivered by known aircraft.

The apparatus may comprise an infrared targeting system carried by at least one of a delivering aircraft or the dispenser. The targeting system may be configured to acquire a source of infrared energy, to select a desired target location relative to the source of infrared energy, and to transmit corresponding target location data to an aircraft weapons delivery system configured to deliver fire retardant from the apparatus to the target location. Thus, a fire, or combustible material ahead of an advancing fire, may be acquired and accurately targeted despite the presence of obscuring smoke or clouds.

Also, a method is provided for delivering fire retardant from an aircraft to a ground fire. According to this method, a fire retardant dispenser apparatus may be provided and releasably attached to a delivering aircraft, the dispenser fuse may be configured to automatically actuate the dispenser casing to dispense the dispenser modules following release from the delivering aircraft and in response to one or more predetermined conditions, a weapons delivery system of the delivering aircraft may be configured to calculate a release envelope for the delivering aircraft to release the apparatus such that the apparatus can deliver the dispenser modules to a desired ground target, taking into consideration the dispenser fuse setting, the aircraft may then be flown into the release envelope, and the apparatus may be released from the delivering aircraft when within the release envelope.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which.

DETAILED DESCRIPTION OF INVENTION EMBODIMENT(S)

Figure 1:
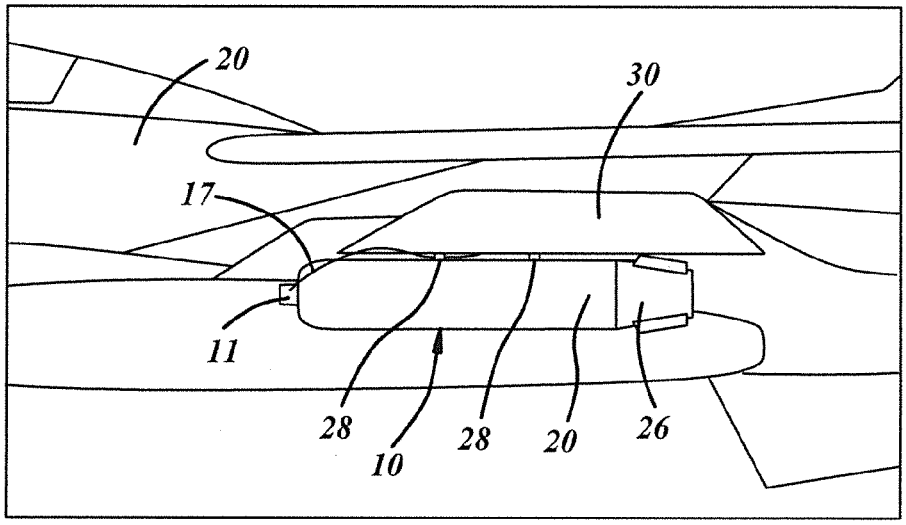
FIG. 1 is a schematic side view of a fire retardant delivery apparatus releasably suspended from a wing pylon of a tactical military aircraft.
Figure 2:
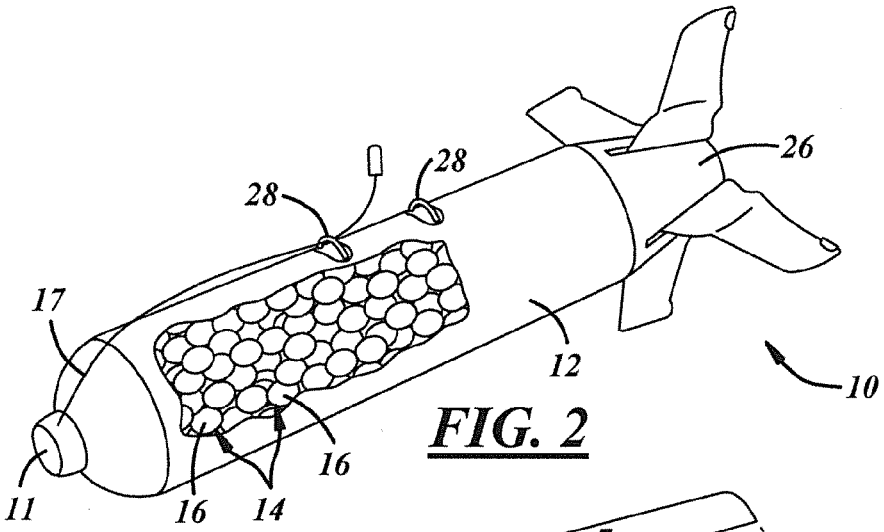
FIG. 2 is a schematic perspective view of the fire retardant delivery apparatus of FIG. 1 with tail fins deployed and with a dispenser casing of the apparatus partially cut away to reveal fire retardant-filled dispenser modules of the apparatus.
Figure 3:
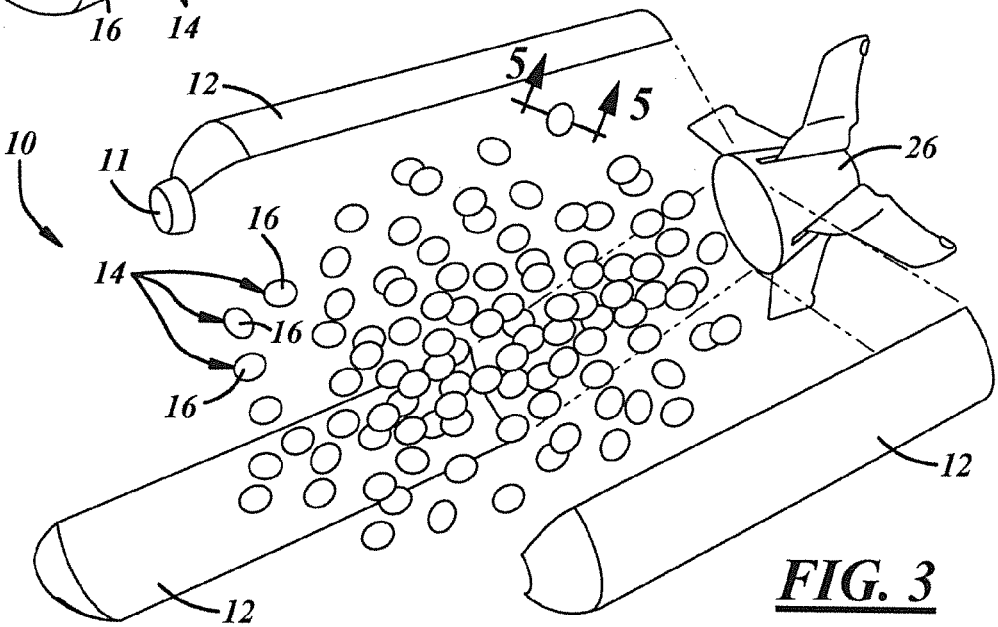
FIG. 3 is a schematic perspective view of the fire retardant delivery apparatus of FIG. 2 with the dispenser casing shown broken open in flight and releasing the dispenser modules.

An apparatus for delivering fire retardant from an aircraft to a ground fire is generally shown at 10 in FIGS. 1-3. For purposes of this application a ground fire is understood to be a fire that is the product of combusting any natural organic or inorganic material or man-made material either in a natural environment or an artificial configuration such as a building or other man-made structure and supported on land on any type of terrain to include mountainous, rolling, or flat; floating on or supported on the floor of a body of water; and in any natural or artificial environment such as forest, grassland, urban, or suburban.

The apparatus 10 may include a dispenser casing 12 configured to be releasably carried by a delivering aircraft 20, and to carry and dispense fire retardant 13. The apparatus 10 may also include a dispenser fuse 11 carried by the dispenser casing 12 and, as shown in FIGS. 1 and 2, connectable by an arming wire 17 to a standard arming wire connector in a weapons suspension and release system 30 of a delivering aircraft 20. The dispenser fuse 11 may be configured to actuate the dispenser casing 12 to dispense the fire retardant 13 by, for example, opening the casing 12 in response to one or more predetermined conditions. The predetermined conditions for dispensing may include events, parameters, or factors such as a predetermined time following release from the delivering aircraft 20, passage through a predetermined pressure altitude, or passage through a predetermined radar-measured altitude above ground level, which values may be as measured by a dispenser fuse timer, altimeter, or radar altimeter, respectively.

The fire retardant 13 may comprise any material commonly used to extinguish and/or impede the progress of a fire. Such materials may include water, or liquid or solid powdered compounds specifically designed to combat fires.

The apparatus 10 may also include a plurality of dispenser modules, as are generally indicated at 14 in FIGS. 2 and 3, which may be releasably carried within the dispenser casing 12 and which may each include a module casing 16 configured to carry and dispense the retardant 13. The dispenser fuse 11 may be configured to release the dispenser modules 14 from the dispenser casing 12 by opening the casing 12, and each dispenser module 14 may be configured to release the retardant 13 from its module casing 16 following release from the dispenser casing 12.

Each dispenser module 14 may be configured to dispense the retardant 13 in response to one or more conditions (e.g., events, parameters, or factors) experienced following module release from the dispenser casing 12, such as the passage of a predetermined time following release from the dispenser casing 12, passage of a predetermined time following ground impact, module passage through a predetermined pressure altitude, module passage through a predetermined radar altitude (i.e., radar-measured altitude above ground level), module ground impact, or module exposure to heat (i.e., infrared energy) of a predetermined magnitude before and/or after module ground impact. The dispenser module casings 16 may comprise a biodegradable material to preclude the dispenser modules 14 from having any long-lasting negative effects on an environment into which they are delivered.

Figure 4:
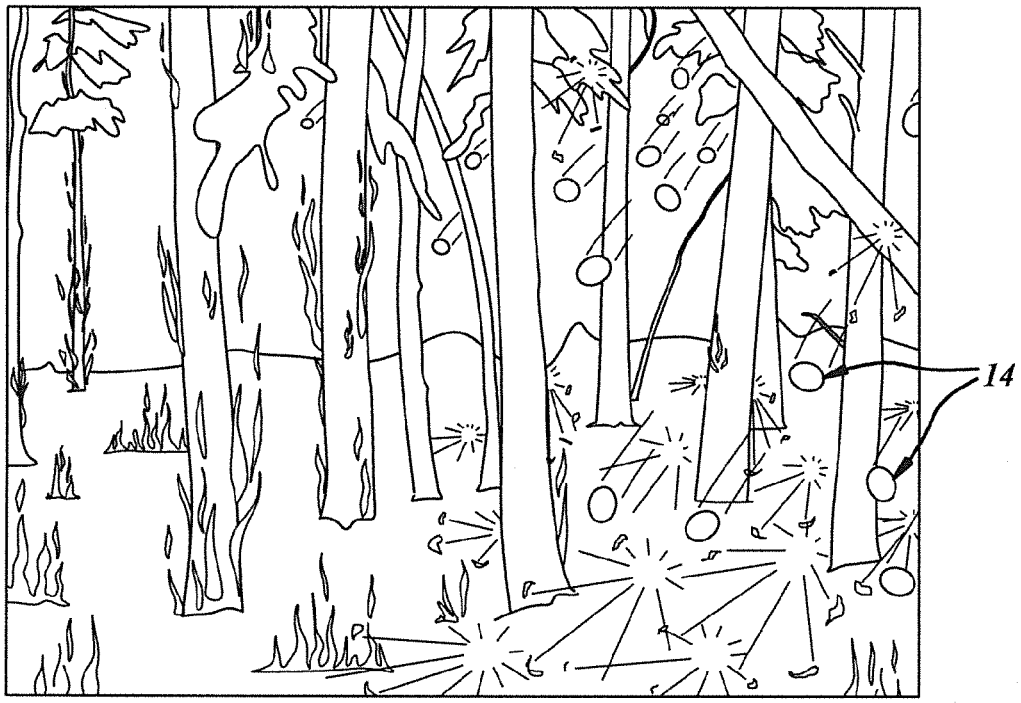
FIG. 4 is a side view of the dispenser modules of FIG. 3 approaching and striking the ground in the midst of a forest fire and breaking upon ground impact and dispensing fire retardant into the fire.
Figure 5:
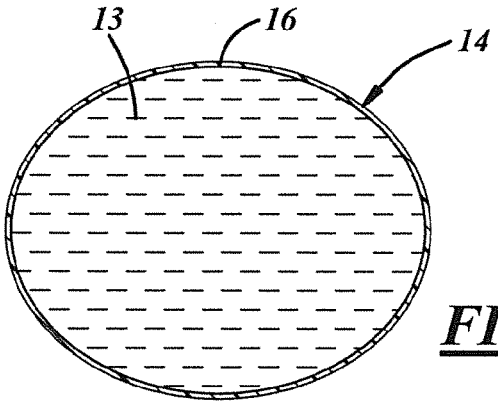
FIG. 5 is a cross sectional view of one of the dispenser modules of FIGS. 2 and 3 and is taken along line 5-5 of FIG. 3.

As best shown in FIGS. 4 and 5, one or more of the apparatus dispenser modules 14 may include module casings 16 that each comprises a flexible, frangible bladder configured to burst and release the retardant 13 upon module ground impact. This configuration provides an extremely low cost dispenser module structure that simply relies on the kinetic energy of the falling modules 14 to break open the module casings 16 and to disperse the retardant 13. To insure bursting upon impact, the module casings 16 may comprise latex, glass, or any other suitable material configured and of sufficient thickness to survive intact until ground impact and weak enough to burst upon ground impact.

Figure 6:
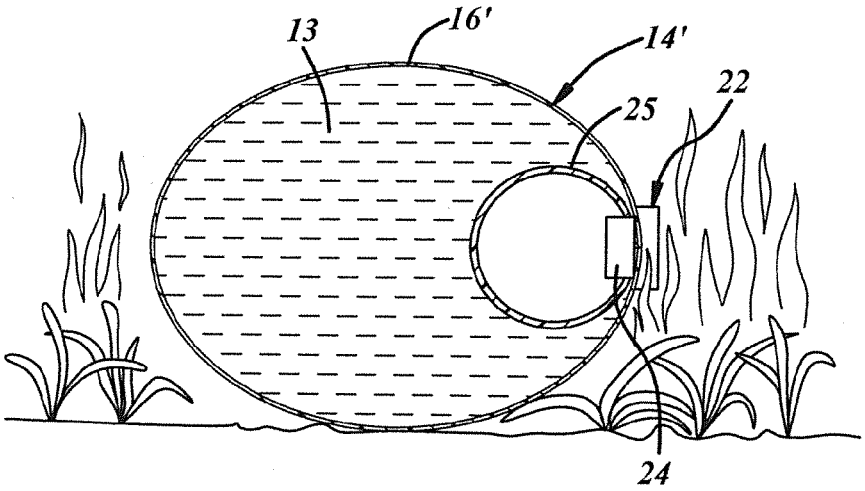
FIG. 6 is a schematic cross-sectional side view of an embodiment of a dispenser module resting on the ground in the midst of a fire, and further showing fire retardant fluid enclosed within a skin that is configured to survive ground impact intact, a heat sensor carried by the skin, a gas charge connected to the heat sensor, and a gas bag in fluid communication with the gas charge.
Figure 7:
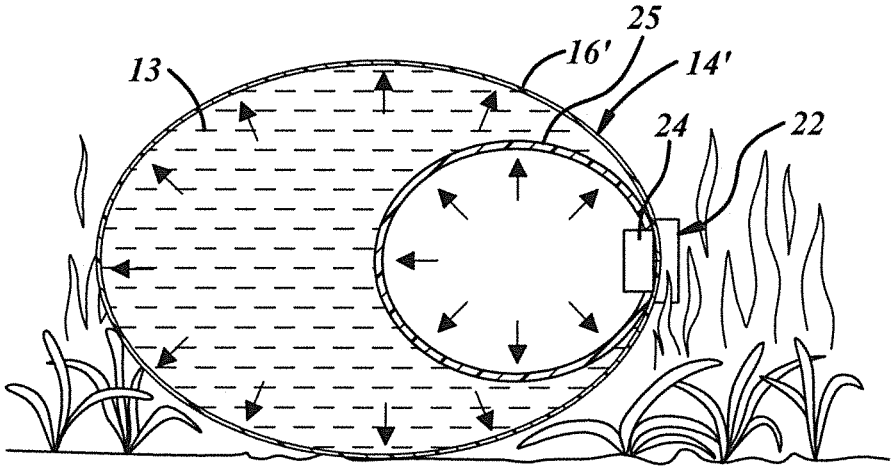
FIG. 7 is a schematic cross-sectional side view of the dispenser module embodiment of FIG. 6 showing the gas charge releasing gas into the gas bag in response to heat sensed by the heat sensor, and further showing the gas bag expanding and applying outward pressure to the dispenser module skin through the fire retardant fluid.
Figure 8:
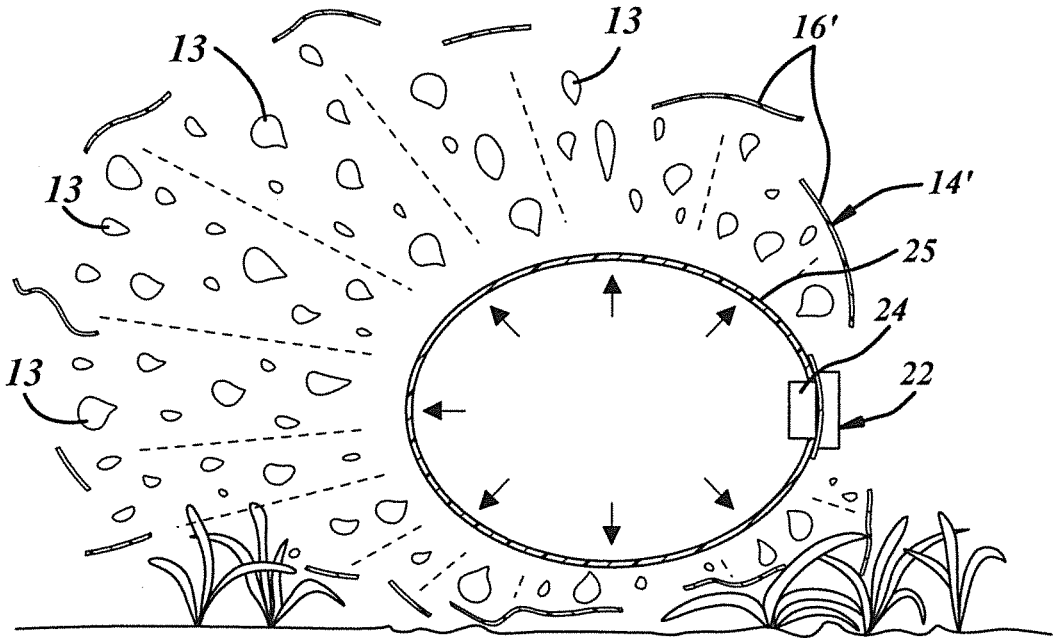
FIG. 8 is a schematic cross-sectional side view of the dispenser module embodiment of FIG. 6 bursting and releasing fire retardant fluid into and extinguishing the surrounding fire.

As shown in FIGS. 6-8, one or more of the apparatus dispenser modules 14' may include module casings 16' that are sufficiently strong to survive ground impact at terminal velocity without rupturing and may be configured to disperse the retardant 13 upon exposure to heat of a predetermined magnitude. These features should ensure that fire retardant 13 will only be released in close proximity to fire either upon descent or at any time following ground impact. These features also allow retardant dispenser modules 14 to be delivered either directly upon a fire, and preferably the hottest portion of a fire, for immediate release of retardant 13, or before an advancing fire line to delay retardant release until the arrival of the fire, thereby halting the fire's advance. To survive ground impact, the dispenser casings 16' may comprise Mylar, or any other suitable material such as aluminum or steel, configured and having sufficient thickness to remain intact upon impact.

As is also shown in FIGS. 6-8, one or more of the dispenser modules 14' may include a retardant dispersal system (generally indicated at 22), that's carried by its module casing 16' and that may be configured to disperse the retardant 13 from the module casing 16 in response to the passage of a predetermined time following ground impact or exposure of a module 14' to heat of a predetermined magnitude. The retardant dispersal system 22 may include a gas charge 24 configured to propel the retardant 13 from the casing 16' by, for example, causing a gas bag 25 to expand rapidly within the module casing 16' so that resultant outward pressure causes the module casing 16' to burst. In other embodiments, retardant may be dispersed from the modules 14' by any other suitable means.

Figure 9:
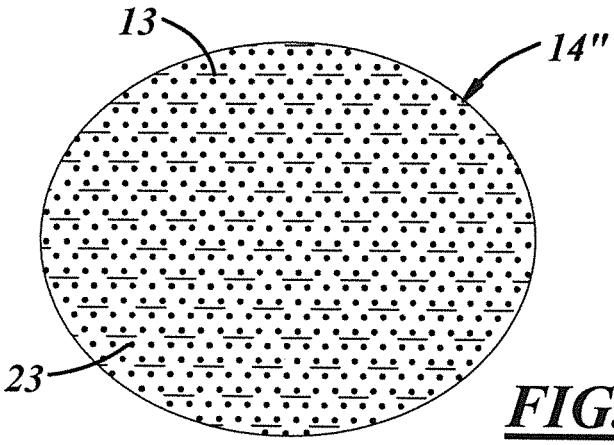
FIG. 9 is a cross sectional view of an alternative dispenser module configuration.

As a further alternative, and as shown in FIG. 9, one or more of the apparatus dispenser modules 14" may comprise a homogeneous mass or "blob" of adsorbent or absorbent material 23 configured to adsorb or absorb the retardant 13 and then release the retardant 13 when the module 14" is compressed by ground impact. The material 23 may, for example, be a superabsorbent polymer or any other suitable material known to absorb or adsorb and retain a significant quantity of liquid.

The dispenser casing 12 and contents may be configured to generally match the ballistic profile of a known cluster bomb unit, which means that the apparatus 10 may be constructed to have a weight, center of gravity, moments of inertia, and outer moldline close enough to that of a known cluster bomb unit to enable a delivering aircraft to deliver the dispenser casing 12 and its contents within the same degree of accuracy as it would the known cluster bomb unit.

The dispenser casing 12 and contents may alternatively be generally ballistically matched to a known cluster bomb unit except that the casing 12 and contents may be heavier than the known cluster bomb unit, and may be configured to be delivered by an aircraft 20 whose weapons delivery system includes a weapons delivery computer 36 (shown in FIG. 8) that has been adjusted (via software update or introduction of compensation values, etc.) to compensate for the increased mass. In this way, the apparatus 10 can carry and deliver a maximum amount of retardant 13 to a targeted fire.

As shown in FIGS. 1 and 2 the apparatus 10 may include suspenders in the form of suspension hardware that may include lugs 28 carried by the dispenser casing 12 and adapted to be releasably engaged by a weapon suspension and release system 30 of a military aircraft 20 that's adapted to releasably support a known cluster bomb unit. In other words, the apparatus 10 is configured to be carried by and released from aircraft 20 adapted to carry a known cluster bomb unit.

Figure 10:
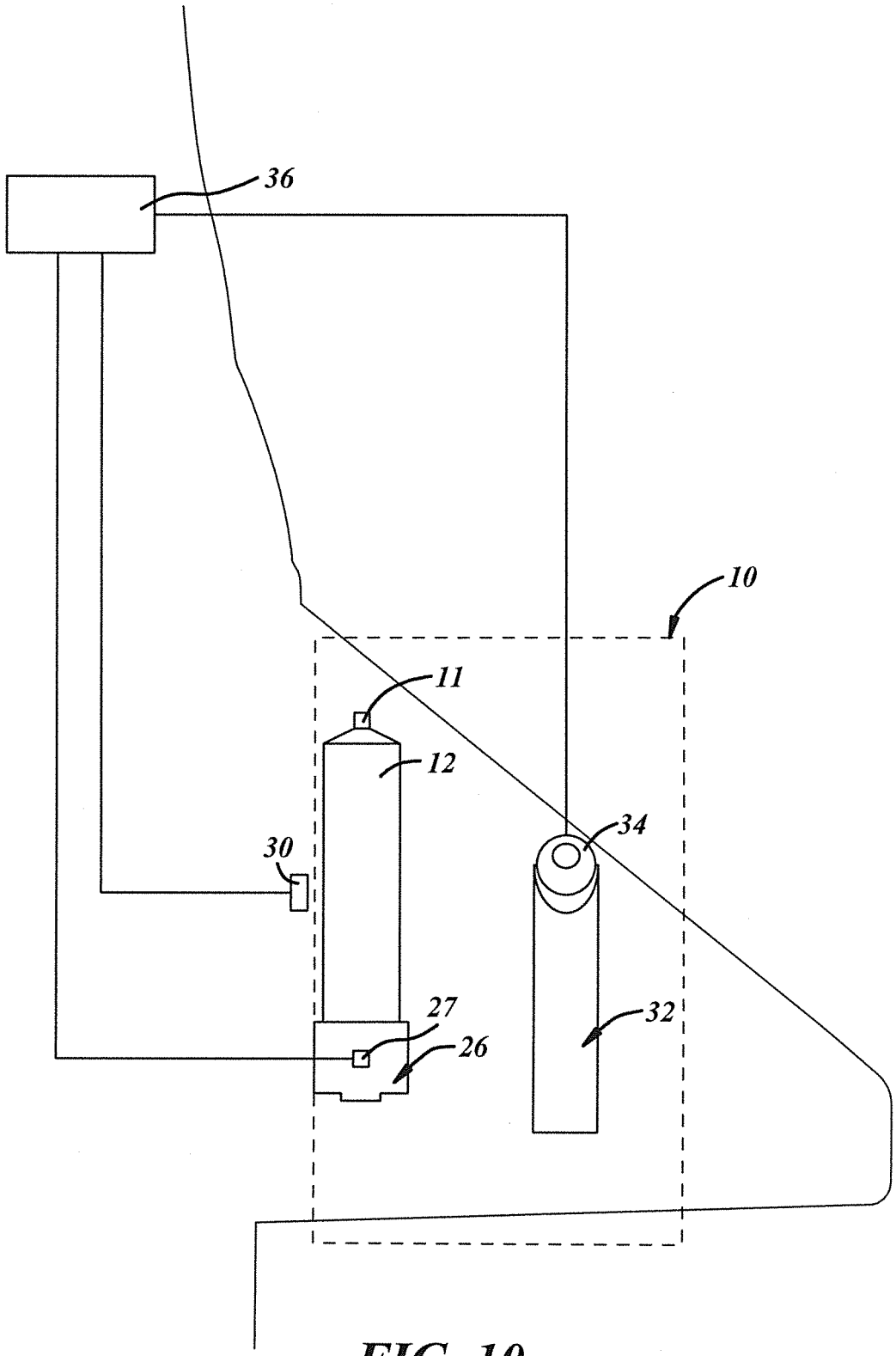
FIG. 10 is a schematic block diagram showing the fire retardant delivery system of FIG. 1 and a targeting pod carried by an aircraft and connected to an aircraft weapons delivery computer.

As best shown in FIG. 10, the apparatus 10 may comprise an infrared targeting system 32 carried by at least one of a delivering aircraft 20 or the dispenser casing 12. The targeting system 32 may be configured to acquire a source of infrared energy (such as a fire), to select and record the coordinates of a desired target location relative to the source of infrared energy, and to transmit corresponding target location data to a weapons delivery computer 36 configured to deliver fire retardant 13 from the apparatus 10 to the target location. In other words, the weapons delivery computer 36 may be configured to calculate and command release of the dispenser casing 12 within a release envelope (range of acceptable altitudes, coordinates, airspeeds, accelerations or g-loadings, headings, and attitudes) and provide the target location data to a guidance system 26 of the apparatus (if the apparatus 10 includes such a guidance system). The infrared targeting system 32 may thus allow for the acquisition and accurate targeting of a fire or combustible material ahead of an advancing fire, which is visually obscured by smoke. The infrared targeting system 32 may also be configured to distinguish and allow for the acquisition and accurate targeting of the hottest part of a fire.

As best shown in FIG. 10, the infrared targeting system 32 may include an infrared sensor 34 carried by, for example, an AN/AAQ-28(V) LITENING targeting pod that is carried by the delivering aircraft 20. The infrared targeting system 32 may be configured to transmit target location data to the aircraft weapons delivery computer 36, which may be configured to deliver the apparatus 10 to a target location by calculating and commanding release of the dispenser casing 12 within a release envelope identified by target location data input to the weapons delivery computer 36.

As is also best shown in FIG. 10, the apparatus 10 may include a guidance system in the form of a tail kit 26 comprising an onboard inertial guidance system 27. The tail kit 26 may, for example, be a wind-corrected munitions dispenser (WCMD) guidance tail kit carried by the dispenser casing 12. The inertial guidance system 27 may be coupleable to and configured to communicate with—the weapons delivery computer 36 of the delivering aircraft 20 and may be configured to guide the dispenser casing 12 toward a selected target in response to target location data received from the infrared targeting system 32 prior to separation from the delivering aircraft 20.

Figure 11:
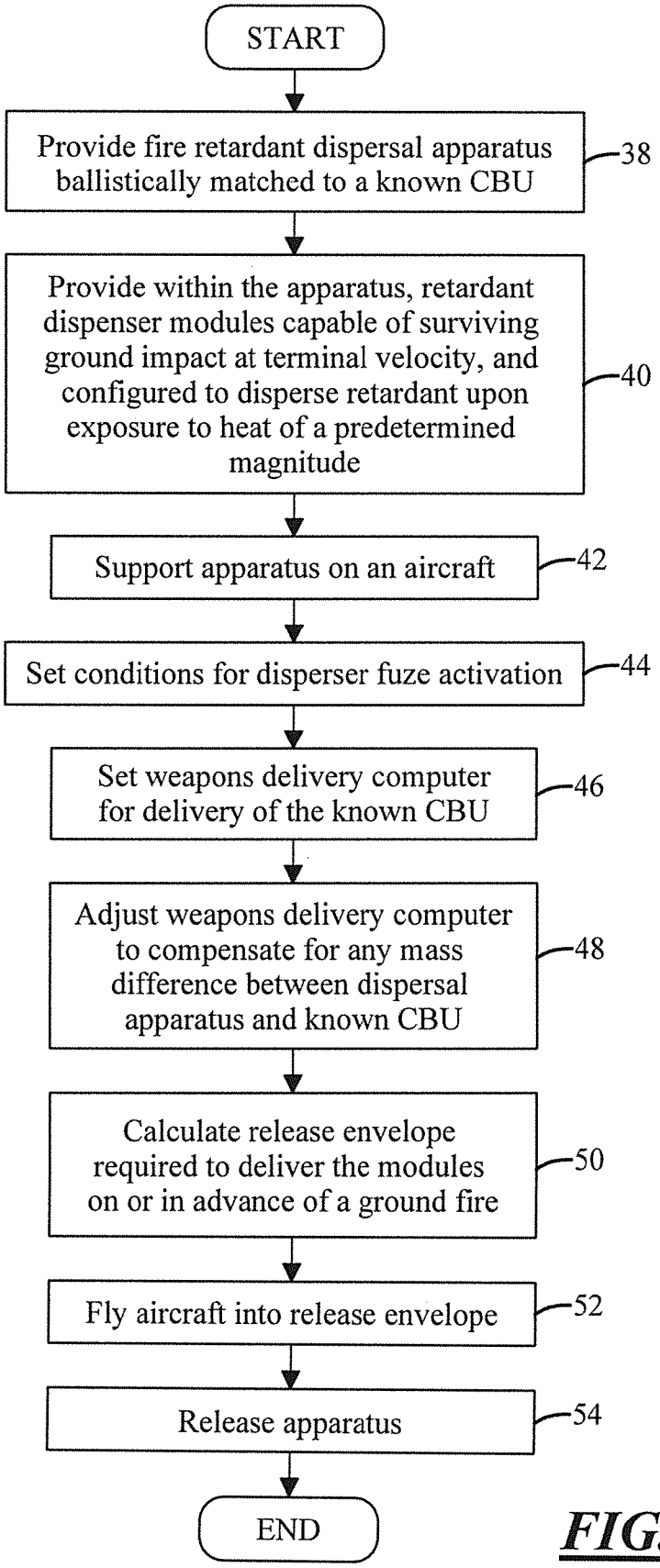
FIG. 11 is a flowchart showing a method of delivering fire retardant to a ground fire.

In practice, fire retardant 13 may be delivered to a ground fire from the aircraft 20 by first attaching the delivery apparatus 10 to the delivering aircraft 20 as shown in action step 42 in FIG. 11, and setting the apparatus' dispenser fuse 11 to open the dispenser casing 12 in response to one or more predetermined conditions following separation from the delivering aircraft 20 as shown in action step 44. If the apparatus 10 has been generally ballistically matched to the ballistic profile of a known cluster bomb unit, then the aircraft's weapons delivery computer 36 may then be set to a preset configured to deliver the known cluster bomb unit as shown in action step 46. If necessary, the weapons delivery computer 36 may also be adjusted via software update or introduction of compensation values, etc. to compensate for any deviation in the mass of the apparatus 10 relative to the known cluster bomb unit as shown in action step 48.

As shown in action step 50 of FIG. 11, the aircraft's weapons delivery computer 36 may then calculate a release envelope for the delivering aircraft 20 to release the apparatus 10 such that the apparatus 10 can deliver the dispenser modules 14 to a desired ground target, taking into consideration the dispenser fuse setting.

As shown by action step 52 of FIG. 11, the aircraft 20 may then be flown into the release envelope calculated by the weapons delivery computer 36, at which point the apparatus 10 may be released from the delivering aircraft 20 as shown in action step 54. The dispenser fuse 11 may then automatically actuate and open the dispenser casing 12 to release the dispenser modules 14 in response to the passage of a predetermined time following release from the delivering aircraft 20, passage through a predetermined pressure altitude, and/or passage through a predetermined radar-measured altitude above ground level.

The dispenser modules 14 may release their payloads of fire retardant 13 at any point before or upon the modules' 14 impact with the ground. Where the dispenser modules 14 are configured to impact the ground without rupturing, they may then await the arrival of the fire or fire line before dispersing fire retardant 13 in response to exposure to a predetermined level of heat.

A fire retardant delivery system as described above may be readily compatible with and accurately deliverable by known tactical aircraft, and may allow fire retardant to be quickly deployed against large-scale wildfires in much the same manner as tactical aircrew are trained to deliver conventional surface-to-ground weapons in a "close air support" or "air interdiction" role. By tasking existing military tactical air combat units and employing existing military logistical infrastructure, large numbers of tactical aircraft can be quickly mobilized in response to emergencies to provide overwhelming support in fighting fires. Such a system provides higher delivery volume, better targeting ability, better delivery accuracy, and faster re-arming capability than existing alternatives. Such peacetime deployments of military air assets would also provide military air and ground crews with valuable practical experience in real-world operations while improving cost efficiencies by simultaneously fulfilling military tactical training requirements. The system may also be used to fight smaller, unconventional fires such as those in buildings and other structures containing hazardous materials, fires high-up on tall city buildings, platforms at sea, and in many other situations where conventional firefighting equipment and techniques are ineffective or inadvisable due to dangerous conditions and/or physical limitations.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A fire retardant delivery apparatus for delivering fire retardant to a ground fire from an aircraft, the apparatus comprising:

a dispenser casing configured to carry and dispense fire retardant and to be releasably carried by a delivering aircraft;

a dispenser fuse carried by the dispenser casing and configured to actuate the dispenser casing to dispense the fire retardant;

a plurality of fire retardant dispenser modules releasably carried by the dispenser casing, the dispenser fuse being configured to release the dispenser modules from the dispenser casing in response to one or more predetermined conditions, at least one dispenser module of the plurality of fire retardant dispenser modules carrying fire retardant and configured to release the retardant following release of the fire retardant dispenser modules from the dispenser casing; and the fire retardant delivery apparatus is ballistically matched to cluster bomb unit comprising bomblets carrying explosive material rather than fire retardant, such that the fire retardant dispenser modules are deliverable to a desired ground target using a release envelope calculated for the cluster bomb unit by a weapons delivery computer of the delivering aircraft.

2. A fire retardant delivery apparatus as defined in claim 1 in which each dispenser module is configured to dispense retardant in response to one or more conditions experienced following module release from the dispenser casing, and at least one of passage of a predetermined time following release from the dispenser casing, module passage through a predetermined pressure altitude, module passage through a predetermined radar altitude, module ground impact, or module exposure to heat of a predetermined magnitude.

3. A fire retardant delivery apparatus as defined in claim 1 in which the at least one dispenser module includes a module casing configured to:

contain fire retardant fluid;

survive ground impact at terminal velocity without rupturing and;

disperse the fire retardant fluid upon exposure to heat of a predetermined magnitude.

4. A fire retarded delivery apparatus as defined in claim 3 in which the at least one dispenser module includes a retardant dispersal system configured to disperse the fire retardant fluid from the module casing in response to the passage of a predetermined time following ground impact and/or in response to module exposure to heat of a predetermined magnitude.

5. A fire retardant delivery apparatus as defined in claim 4 in which the retardant dispersal system includes a gas charge configured to propel the fire retardant fluid from the module casing.

6. A fire retardant delivery apparatus as defined in claim 1 in which the module casing of the at least one dispenser module is configured to burst and release the fire retardant fluid upon module ground impact.

7. A fire retardant delivery apparatus as defined in claim 1 in which the fire retardant delivery apparatus is heavier than the cluster bomb unit.

8. A fire retardant delivery apparatus as defined in claim 1 in which the apparatus includes suspenders carried by the dispenser casing and adapted to be releasably engaged by a weapon suspension and release system of a military aircraft adapted to releasably support a known cluster bomb unit.

9. A fire retardant delivery apparatus as defined in claim 1 in which the dispenser module casings comprise a biodegradable material.

10. A fire retardant delivery apparatus as defined in claim 1 in which the apparatus includes an arming wire connectable between the dispenser fuse and a standard arming wire connector of the delivering aircraft.

11. A fire retardant delivery apparatus as defined in claim 1 in which one or more of the apparatus dispenser modules comprises a mass of absorbent material configured to absorb, retain and subsequently release liquid retardant when the one or more dispenser modules are compressed upon impact with a targeted surface.

12. A fire retardant delivery apparatus as defined in claim 11 in which the absorbent material comprises a superabsorbent polymer.

* * * * *